US008565639B2

(12) United States Patent
Nittani et al.

(10) Patent No.: US 8,565,639 B2
(45) Date of Patent: Oct. 22, 2013

(54) PROCESS CARTRIDGE AND IMAGE FORMING APPARATUS

(75) Inventors: Susumu Nittani, Suntou-gun (JP); Kazunari Murayama, Numazu (JP); Hideki Maeshima, Mishima (JP); Yukio Kubo, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 225 days.

(21) Appl. No.: 13/162,029

(22) Filed: Jun. 16, 2011

(65) Prior Publication Data

US 2011/0311272 A1 Dec. 22, 2011

(30) Foreign Application Priority Data

Jun. 22, 2010 (JP) ..... 2010-141622
May 31, 2011 (JP) ..... 2011-122385

(51) Int. Cl.
*G03G 21/16* (2006.01)

(52) U.S. Cl.
USPC ..... 399/111

(58) Field of Classification Search
USPC ..... 399/111, 112, 113, 116, 119, 262
See application file for complete search history.

(56) References Cited

U.S. PATENT DOCUMENTS 6,131,011 A 10/2000 Kojima et al.
6,157,792 A 12/2000 Mori et al.
6,178,301 B1 1/2001 Kojima et al.
6,266,503 B1 7/2001 Murayama et al.
6,289,189 B1 9/2001 Numagami et al.
6,298,217 B1 10/2001 Murayama et al.
6,314,266 B1 11/2001 Murayama et al.
6,385,416 B1 5/2002 Horikawa et al.
6,404,996 B1 6/2002 Mori et al.
6,442,359 B1 8/2002 Numagami et al.
6,459,869 B2 10/2002 Nittani et al.
6,463,233 B2 10/2002 Kojima et al.
6,463,234 B2 10/2002 Arimitsu et al.
6,577,831 B1 6/2003 Kojima et al.
6,608,980 B2 8/2003 Murayama et al.
6,681,088 B2 * 1/2004 Kanno et al. ..... 399/111
6,714,752 B2 3/2004 Ueno et al.
6,823,153 B2 11/2004 Ueno et al.
6,829,455 B2 12/2004 Yasumoto et al.
6,834,171 B2 12/2004 Nittani et al.
6,834,175 B2 12/2004 Murayama et al.

(Continued)

FOREIGN PATENT DOCUMENTS

JP 2007-213025 8/2007

*Primary Examiner* — David Gray
*Assistant Examiner* — Thomas Giampaolo, II
(74) *Attorney, Agent, or Firm* — Fitzpatrick, Cella, Harper & Scinto

(57) ABSTRACT

A process cartridge detachably mountable to a main assembly of an image forming apparatus. The process cartridge includes a photosensitive member unit including an electrophotographic photosensitive member, and a developing unit including a developing roller for developing an electrostatic latent image formed on the photosensitive member, the developing unit being movable between a contact position in which the developing roller is contacted to the photosensitive member and a separated position in which the developing roller is separated from the photosensitive member. The process cartridge also includes a drive transmitting portion for transmitting a driving force for driving the developing roller at one longitudinal end side of the developing unit. The drive transmitting portion provides to the developing unit a force for moving the developing unit in a direction from the separated position toward the contact position by receiving the driving force.

10 Claims, 14 Drawing Sheets

(56) References Cited

U.S. PATENT DOCUMENTS

| | | | | |
|---|---|---|---|---|
| 6,898,391 | B2 | 5/2005 | Numagami et al. | |
| 6,912,365 | B2 | 6/2005 | Ueno et al. | |
| 6,947,686 | B2 | 9/2005 | Kawai et al. | |
| 6,968,142 | B2 | 11/2005 | Arimitsu et al. | |
| 6,978,099 | B2 | 12/2005 | Ueno et al. | |
| 6,980,758 | B2 | 12/2005 | Murayama et al. | |
| 6,990,302 | B2 | 1/2006 | Toba et al. | |
| 7,024,137 | B2 | 4/2006 | Nittani et al. | |
| 7,027,756 | B2 | 4/2006 | Hoshi et al. | |
| 7,046,942 | B2 | 5/2006 | Arimitsu et al. | |
| 7,072,594 | B2 | 7/2006 | Hoshi et al. | |
| 7,072,603 | B2 | 7/2006 | Tsuzuki et al. | |
| 7,088,938 | B2 | 8/2006 | Hashimoto et al. | |
| 7,088,939 | B2 | 8/2006 | Maeshima et al. | |
| 7,092,658 | B2 | 8/2006 | Yasumoto et al. | |
| 7,127,194 | B2 | 10/2006 | Hoshi et al. | |
| 7,158,735 | B2 | 1/2007 | Murayama et al. | |
| 7,162,174 | B2 | 1/2007 | Suzuki et al. | |
| 7,162,181 | B2 | 1/2007 | Maeshima et al. | |
| 7,215,909 | B2 | 5/2007 | Nittani et al. | |
| 7,272,339 | B2 | 9/2007 | Tsuzuki et al. | |
| 7,340,197 | B2 | 3/2008 | Murayama et al. | |
| 7,346,293 | B2 | 3/2008 | Suzuki et al. | |
| 7,349,649 | B2 | 3/2008 | Hoshi et al. | |
| 7,386,241 | B2 | 6/2008 | Mori et al. | |
| 7,509,071 | B2 | 3/2009 | Yoshimura et al. | |
| 7,512,361 | B2 | 3/2009 | Kawamura et al. | |
| 7,715,746 | B2 | 5/2010 | Tanabe et al. | |
| 7,813,671 | B2 | 10/2010 | Nittani et al. | |
| 7,856,192 | B2 | 12/2010 | Koishi et al. | |
| 7,860,433 | B2 | 12/2010 | Toba et al. | |
| 7,869,740 | B2 | 1/2011 | Yoshimura et al. | |
| 7,890,012 | B2 | 2/2011 | Koishi et al. | |
| 7,894,733 | B2 | 2/2011 | Tanabe et al. | |
| 7,953,340 | B2 | 5/2011 | Tanabe et al. | |
| 2007/0160388 | A1* | 7/2007 | Yoshimura et al. | 399/111 |
| 2008/0138107 | A1* | 6/2008 | Mori et al. | 399/111 |
| 2008/0159773 | A1 | 7/2008 | Murayama et al. | |
| 2009/0003876 | A1 | 1/2009 | Maeshima et al. | |
| 2011/0064459 | A1 | 3/2011 | Toba et al. | |
| 2011/0116832 | A1 | 5/2011 | Koishi et al. | |
| 2011/0123223 | A1 | 5/2011 | Koishi et al. | |
| 2011/0200353 | A1 | 8/2011 | Kubo et al. | |
| 2011/0206412 | A1 | 8/2011 | Tanabe et al. | |

* cited by examiner (A)

(B)

(A)

(B)

(A)

(B)

(A)

(B)

(A)

(B)

PROCESS CARTRIDGE AND IMAGE FORMING APPARATUS

FIELD OF THE INVENTION AND RELATED ART

The present invention relates to a process cartridge and an image forming apparatus. Particularly, the present invention relates to the process cartridge suitably used in the image forming apparatus, which is of an electrophotographic type, such as a copying machine or a printer (e.g., a laser printer or an LED printer), in which an image is formed on a recording material (e.g., paper or an OHP sheet).

Here, the process cartridge is prepared by integrally assembling an electrophotographic photosensitive drum and a developing means as process means into a cartridge, which is detachably mountable to a main assembly of the image forming apparatus. The contact can be mounted to and demounted form the main assembly by a user himself (herself). For that reason, maintenance of the apparatus main assembly can be easily performed. Further, in the process cartridge in the present invention, the electrophotographic photosensitive member on which a latent image is to be formed and a developing roller for development can be contacted to and separated from each other.

In a conventional image forming apparatus using an electrophotographic image forming process, a process cartridge type in which the photosensitive drum as an image bearing member and a developing roller as a developer carrying member for development are detachably mountable to a main assembly of the electrophotographic image forming apparatus has been employed. According to the process cartridge type, maintenance of the apparatus can be performed by the user himself (herself) without relying on a service person. For that reason, the process cartridge type has been widely used in the electrophotographic image forming apparatus.

Here, in the case where the image is formed, the developing roller is in a state in which it is urged toward the photosensitive drum at predetermined pressure. Further, in a contact developing system in which the developing roller contacts the photosensitive drum to effect development, an elastic layer of the developing roller is in a state in which it contacts a surface of the photosensitive drum at predetermined pressure. For that reason, in the case where the process cartridge is not used for a long time in a state in which it is mounted in the main assembly of the electrophotographic image forming apparatus, the elastic layer of the developing roller can be deformed. As a result, density non-uniformity of the image occurs during the development in some cases. Further, the developing roller contacts the photosensitive drum and therefore an unnecessary developer is moved from the developing roller to the photosensitive drum and deposited on the photosensitive drum in some cases. Further, in the case where the photosensitive drum and the developing roller are rotated in contact with each other in a period other than during the development, due to sliding between the photosensitive drum and the developing roller, deterioration of the photosensitive drum, the developing roller and the developer can be accelerated.

In order to solve the above problems, Japanese Laid-Open Patent Application 2007-213025 has proposed an electrophotographic image forming apparatus in which a mechanism for separating the photosensitive drum and the developing roller, in the case where image formation is not effected, by acting on the process cartridge. Specifically, with respect to a longitudinal direction a contact and separation mechanism between the photosensitive drum and the developing roller, an urging spring for the contact is provided at a non-driving end side and on the other hand a force receiving portion for receiving a force for the separation is provided at a driving end side opposite from the non-driving end side with respect to the longitudinal direction.

SUMMARY OF THE INVENTION

The present invention is further development of the conventional image forming apparatus. A principal object of the present invention is to provide a process cartridge capable of suppressing a longitudinal torsional force occurring in a contact and separation mechanism between a photosensitive drum and a developing roller.

Another object of the present invention is to provide an image forming apparatus including the process cartridge.

According to an aspect of the present invention, there is provided a process cartridge detachably mountable to a main assembly of an image forming apparatus, comprising:

a photosensitive member unit including an electrophotographic photosensitive member;

a developing unit, including a developing roller for developing an electrostatic latent image formed on the electrophotographic photosensitive member, movable between a contact position in which the developing roller is contacted to the electrophotographic photosensitive member and a separated position in which the developing roller is separated from the electrophotographic photosensitive member;

a drive transmitting portion for transmitting a driving force for driving the developing roller at one longitudinal end side of the developing unit, wherein the drive transmitting portion provides, to the developing unit, a force for moving the developing unit in a direction from the separated position toward the contact position by receiving the driving force;

an urging member for urging, at the other longitudinal end side of the developing unit, the developing unit so that the developing unit is moved in the direction from the separated position toward the contact position; and a force receiving portion, provided only at the other longitudinal end side of the developing unit, for receiving a force, from the main assembly, for moving the developing unit from the contact position to the separated position.

According to another aspect of the present invention, there is provided an image forming apparatus for forming an image on a recording material, comprising:

(i) a process cartridge detachably mountable to a main assembly of an image forming apparatus, comprising:

a photosensitive member unit including an electrophotographic photosensitive member;

a developing unit, including a developing roller for developing an electrostatic latent image formed on the electrophotographic photosensitive member, movable between a contact position in which the developing roller is contacted to the electrophotographic photosensitive member and a separated position in which the developing roller is separated from the electrophotographic photosensitive member;

a drive transmitting portion for transmitting a driving force for driving the developing roller at one longitudinal end side of the developing unit, wherein the drive transmitting portion provides, to the developing unit, a force for moving the developing unit in a direction from the separated position toward the contact position by receiving the driving force;

an urging member for urging, at the other longitudinal end side of the developing unit, the developing unit so that the developing unit is moved in the direction from the separated position toward the contact position; and a force receiving portion, provided only at the other longitudinal end side of the developing unit, for receiving a force, from the main assembly, for moving the developing unit from the contact position to the separated position; and (ii) conveying means for conveying the recording material.

These and other objects, features and advantages of the present invention will become more apparent upon a consideration of the following description of the preferred embodiments of the present invention taken in conjunction with the accompanying drawings.

BRIEF DESCRIPTION OF THE DRAWINGS

Part (A) of FIG. 1 is a sectional view of a process cartridge at a non-driving end side in the case where image formation is not effected in an embodiment of the present invention, and (B) of FIG. 1 is a plan view of the process cartridge at a driving end side and the non-driving end side in the case where the image formation is not effected.

Figure 4:
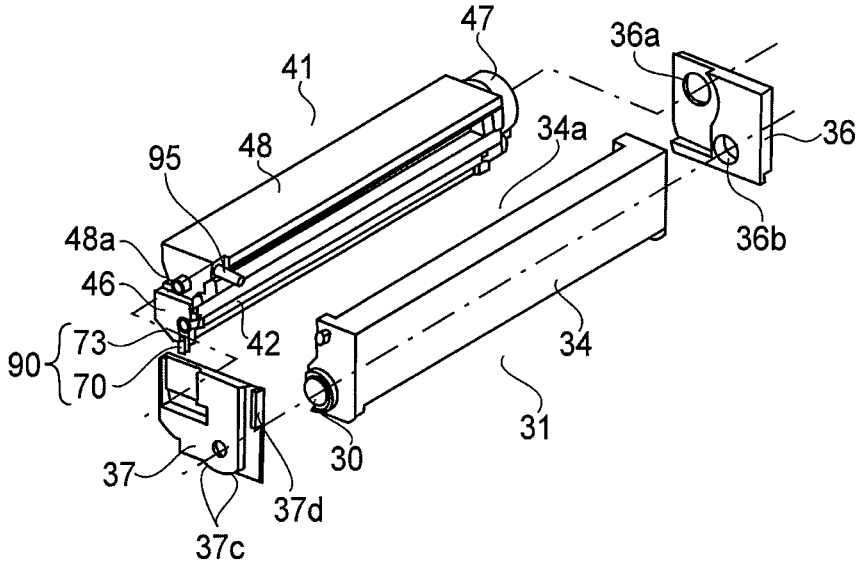
Figure 4:
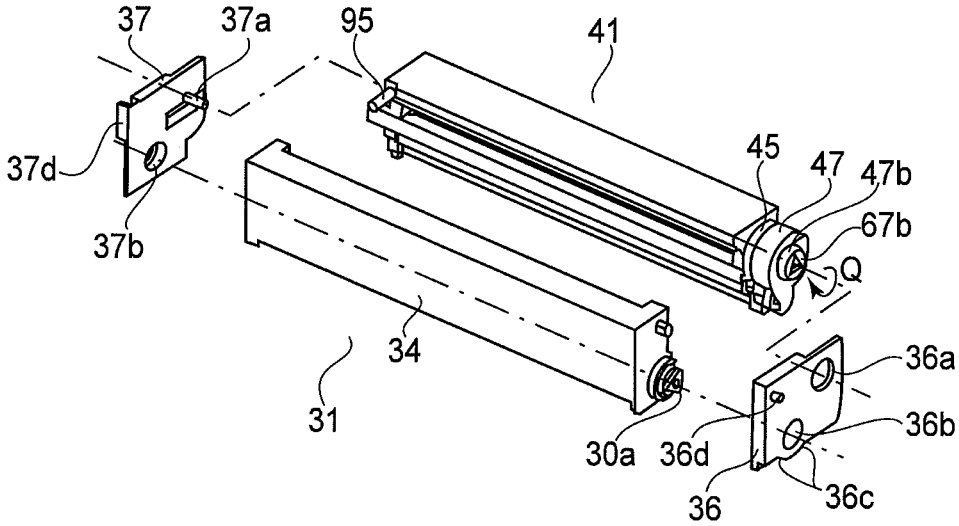

Part (A) of FIG. 4 is an exploded perspective view of the process cartridge basically at the non-driving end side, and (B) of FIG. 4 is an exploded perspective view of the process cartridge basically at the driving end side.

Figure 5:
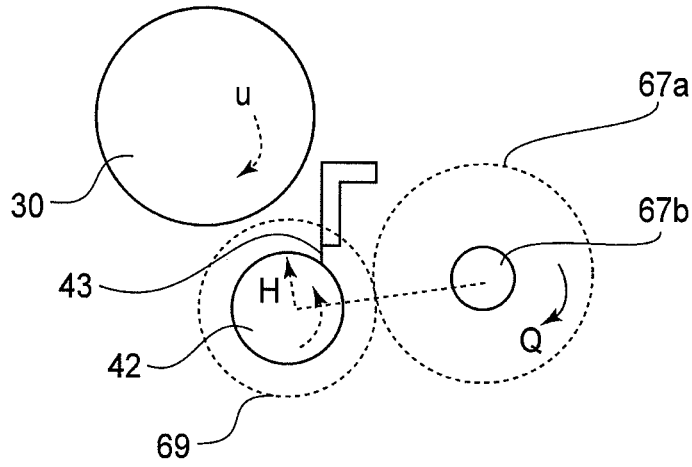
Figure 5:
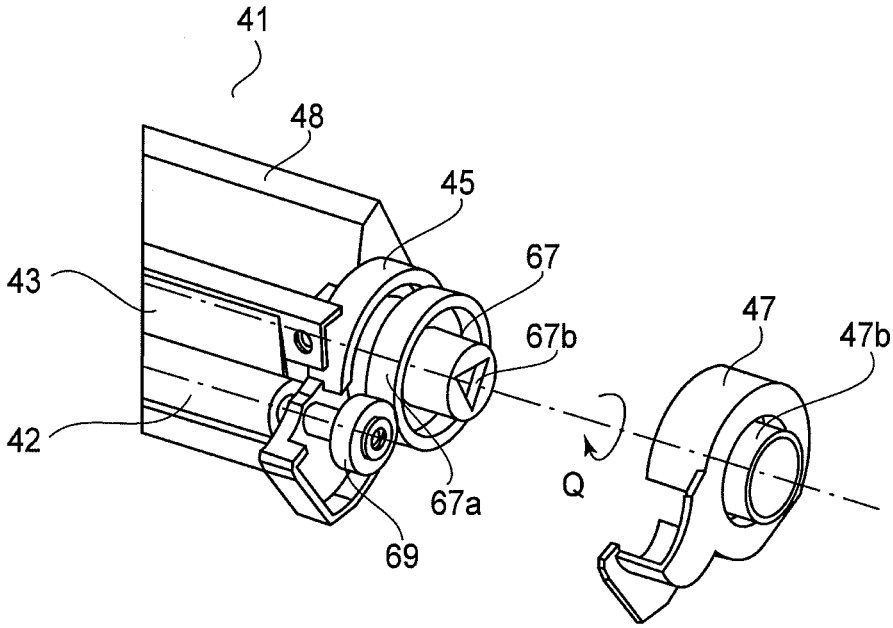

Parts (A) and (B) of FIG. 5 are schematic views showing the process cartridge and its driving system, wherein (A) is a schematic diagram and (B) is an exploded perspective view.

Figure 6:
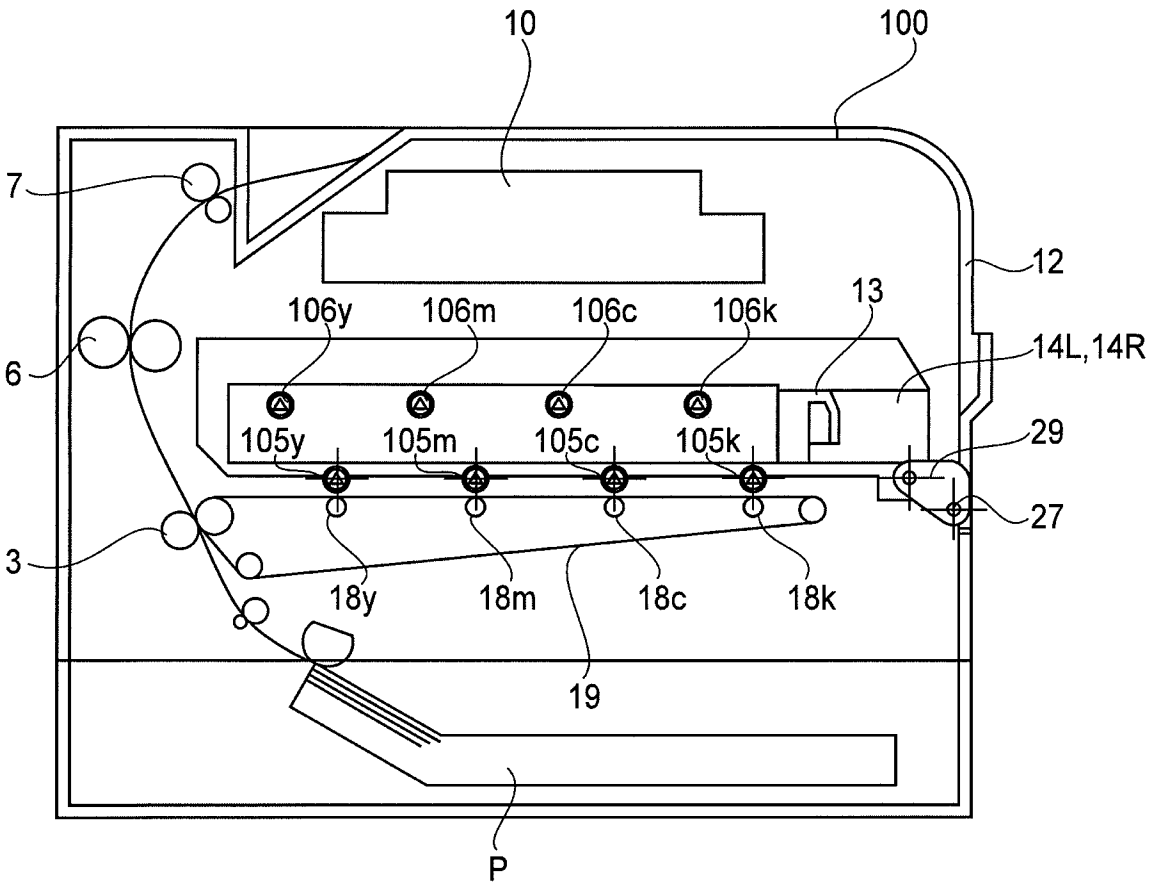

FIG. 6 is a sectional view showing a structure of a drive transmitting portion of the electrophotographic image forming apparatus.

Figure 7:
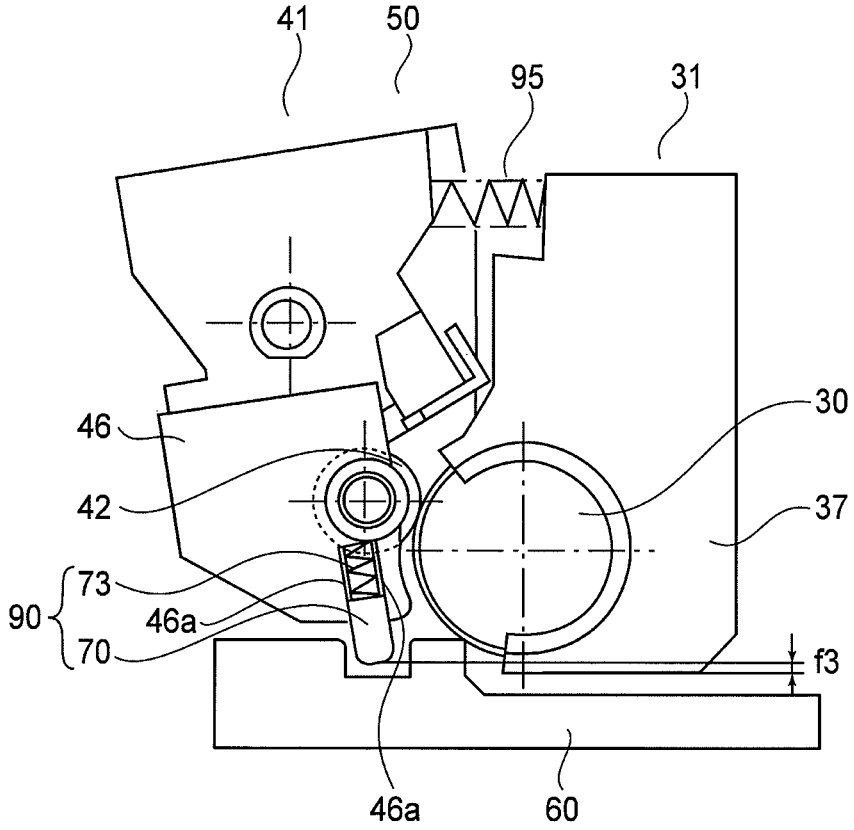

FIG. 7 is a partial sectional view showing a contact and separation mechanism at a non-driving end side of a developing roller.

Figure 8:
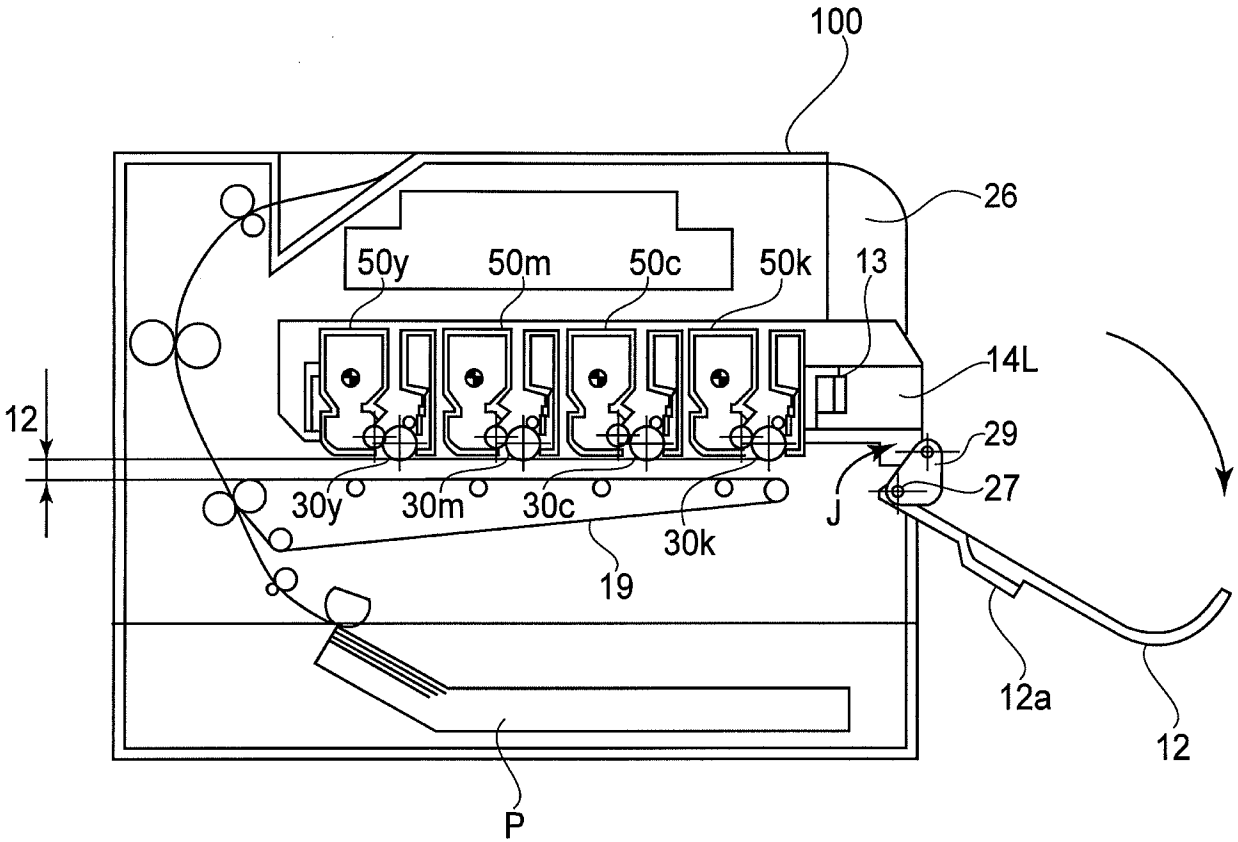

FIG. 8 is a sectional view for illustrating a state in which a cartridge tray during image formation is raised for pulling out.

Figure 9:
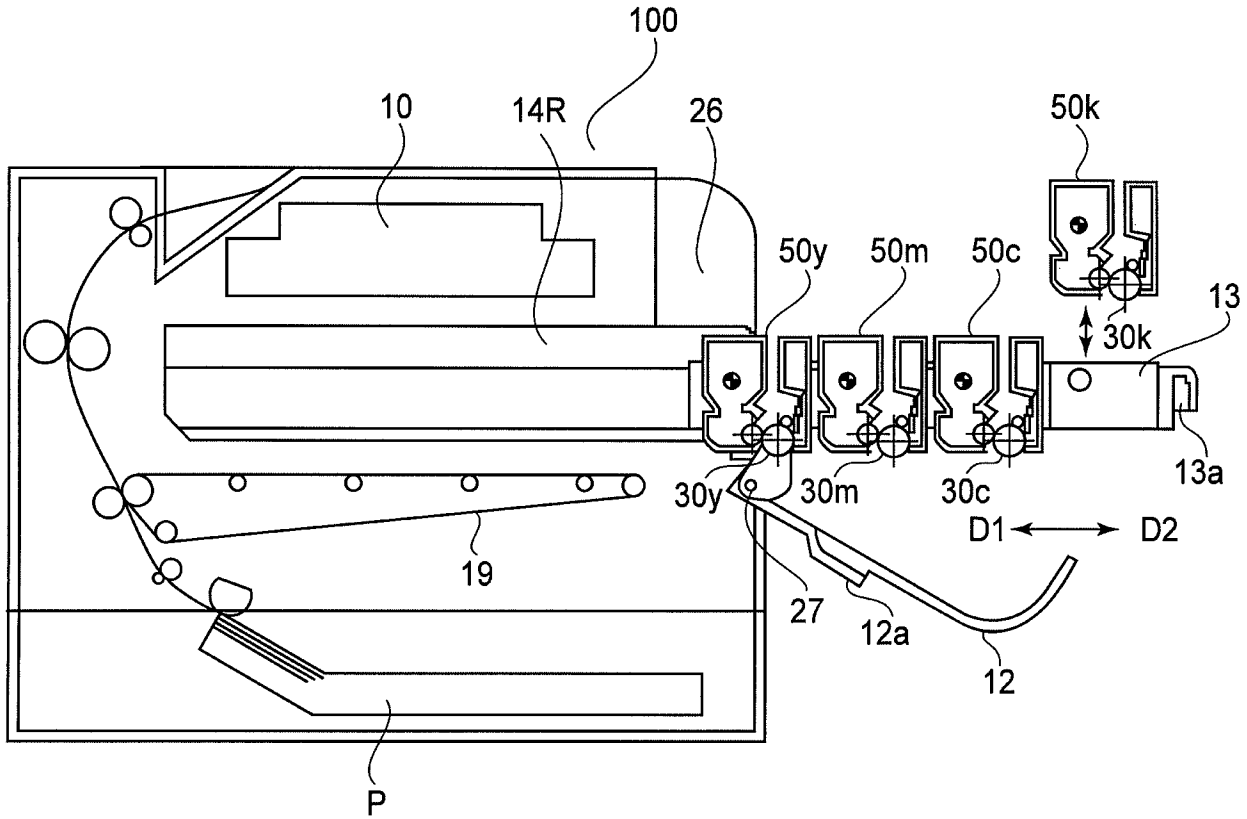

FIG. 9 is a sectional view showing a pulling-out state of the cartridge tray.

Figure 10:
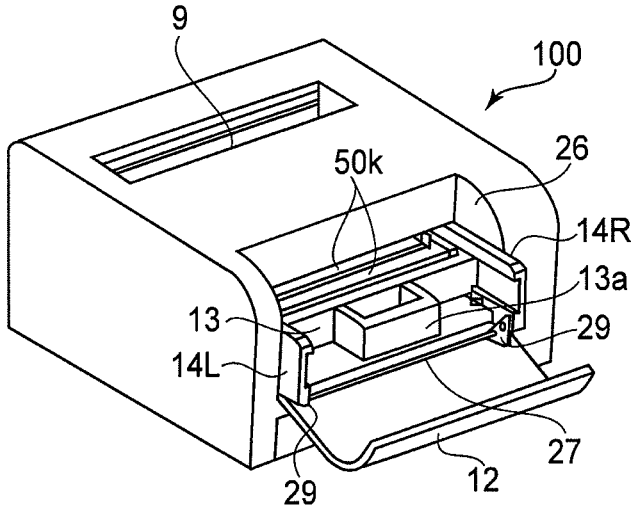
Figure 10:
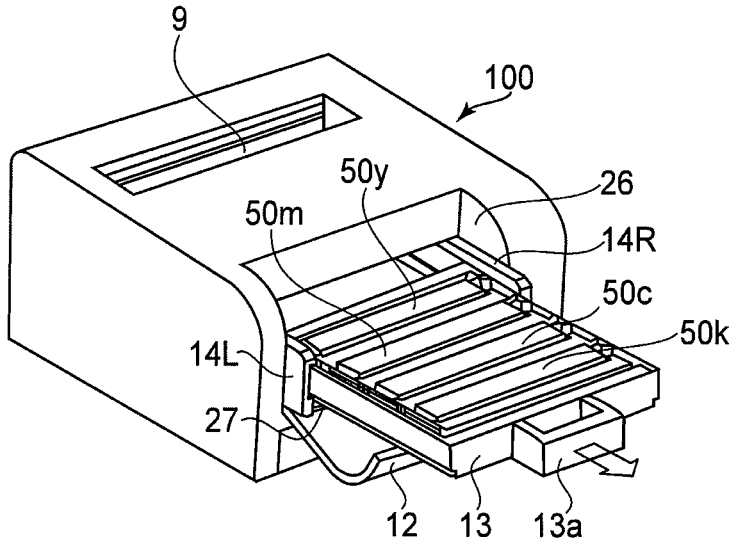

Part (A) of FIG. 10 is a perspective view showing a state in which a door is opened, and (B) of FIG. e10 is a perspective view showing a state in which the cartridge tray is pulled out through the door.

Figure 11:
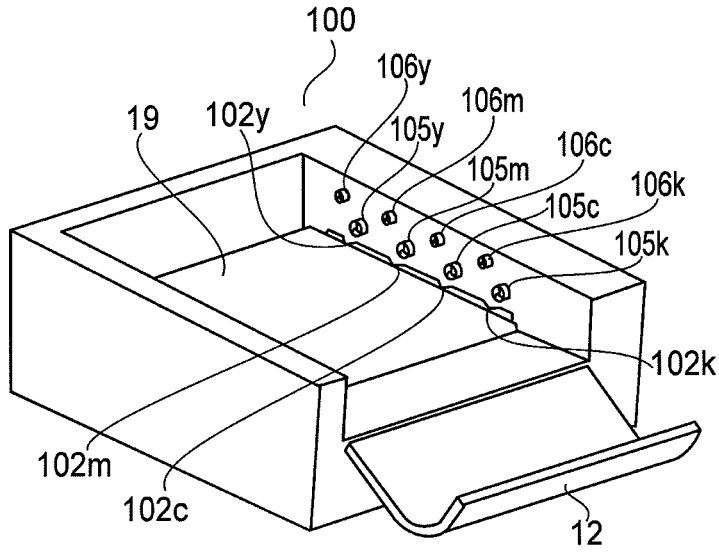
Figure 11:
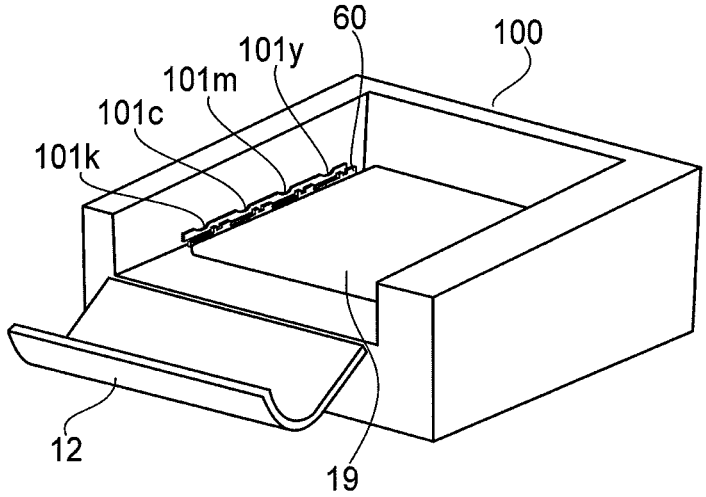

Part (A) of FIG. 11 is a perspective view of a positioning portion at the driving end side, and (B) of FIG. 11 is a perspective view of a positioning portion at the non-driving end side.

Figure 12:
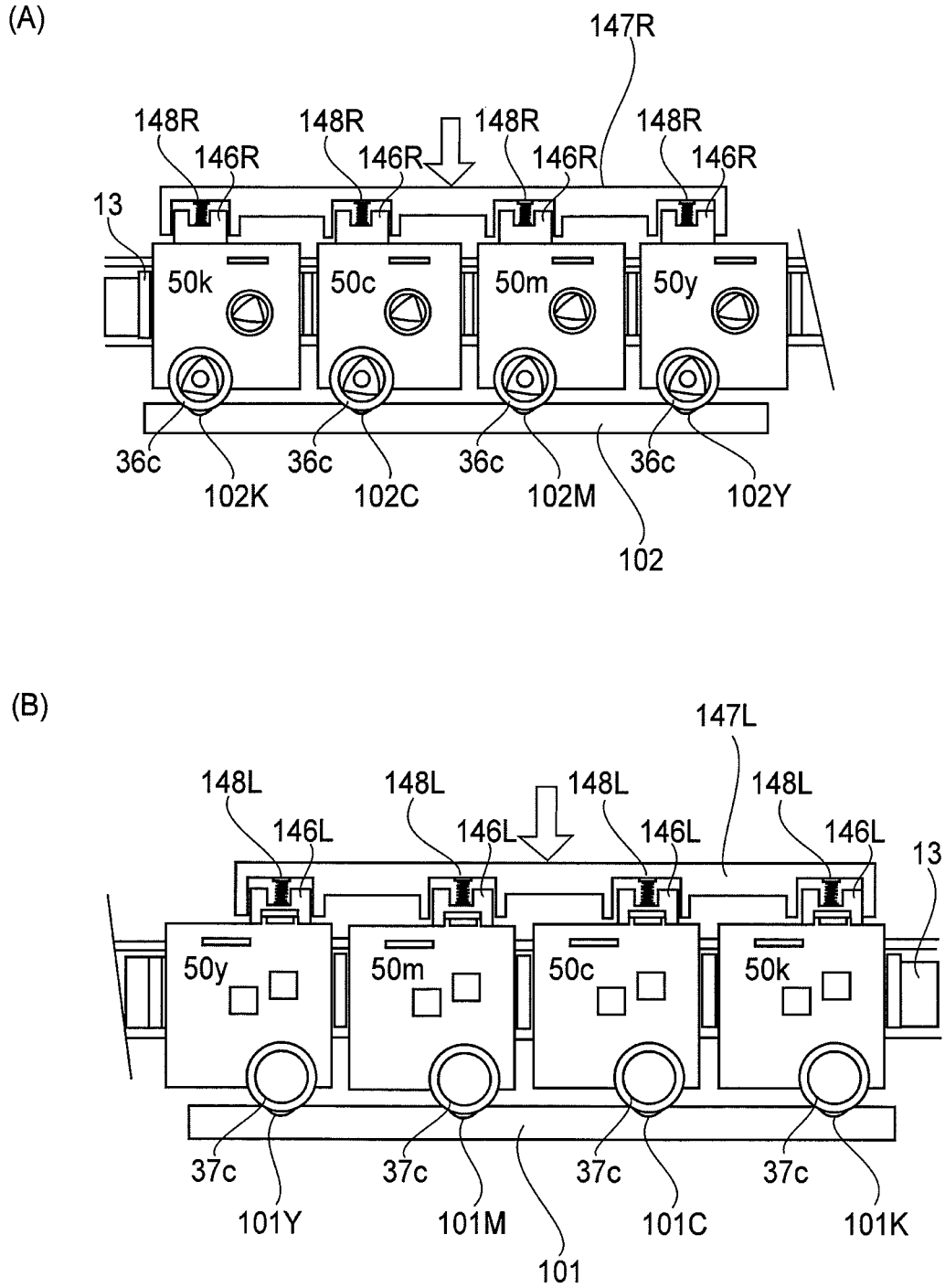

Part (A) of FIG. 12 is a side view of the positioning portion at the driving end side, and (B) of FIG. 11 is a side view of the positioning portion at the non-driving end side.

Figure 13:
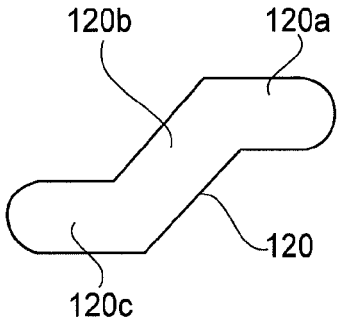

FIG. 13 is an illustration of a groove shape of a main assembly-side guide portion for moving a cartridge.

Figure 14:
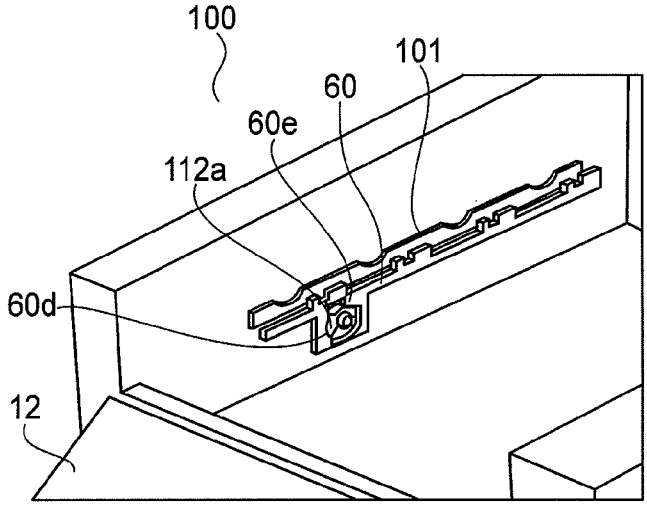

FIG. 14 is an illustration of a main assembly side force imparting member for separating the developing roller.

Figure 15:
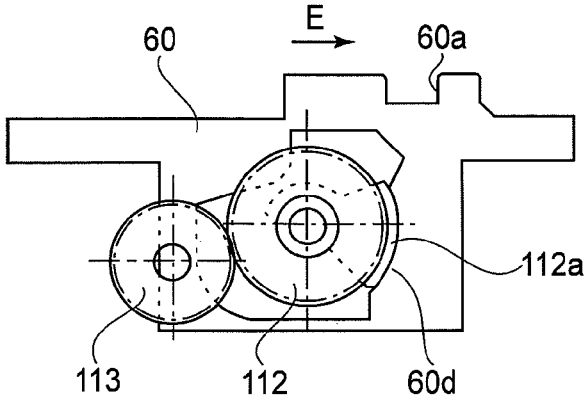

FIG. 15 is a sectional view for illustrating an operation of the main assembly-side force imparting member for separating the developing roller.

Figure 16:
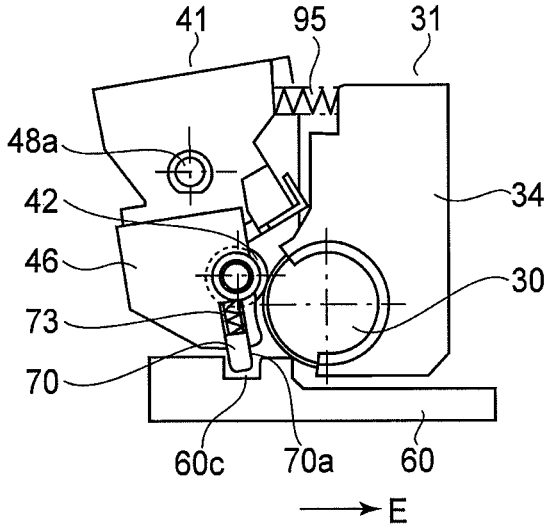
Figure 16:
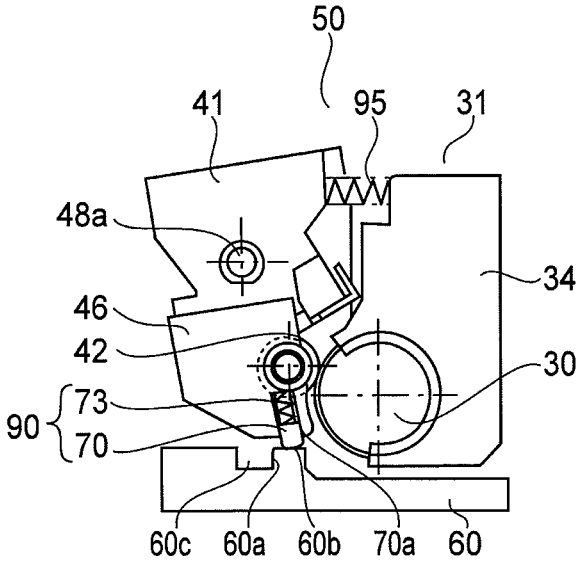

Part (A) of FIG. 16 is a sectional view of the process cartridge at the non-driving end side during the image formation, and (B) of FIG. 16 is a sectional view showing a state of the process cartridge at the non-driving end side before the image formation is effected in a state in which the process cartridge is inserted into the apparatus main assembly.

DESCRIPTION OF THE PREFERRED EMBODIMENTS

Hereinbelow, embodiments of the present invention will be described with reference to the drawings.

Incidentally, in the following, the same or corresponding portions or members are represented by the same reference numerals or symbols.

First Embodiment

Image Forming Apparatus

Figure 2:
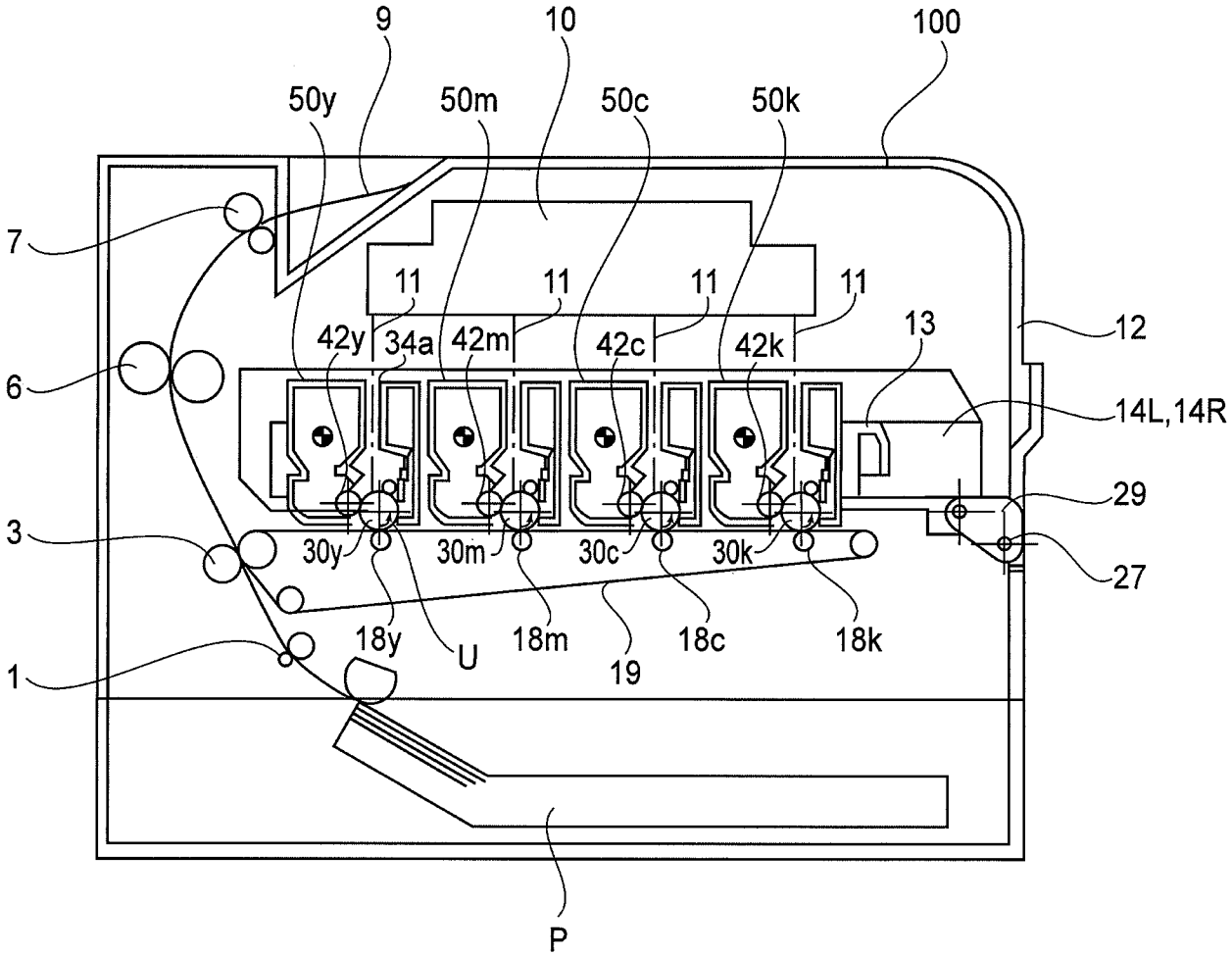
FIG. 2 is a general arrangement of an electrophotographic image forming apparatus in the embodiment.

FIG. 2 is a sectional side view of an image forming apparatus, in which a plurality of process cartridges 50 (50*y*, 50*m*, 50*c*, 50*k*) are detachably mounted at a process cartridge mount portion. The plurality of process cartridges 50*y*, 50*m*, 50*c* and 50*k* accommodate toners (developers) of yellow, magenta, cyan and black, respectively. In an apparatus main assembly 100, the surface of each of electrophotographic photosensitive drums 30 (30*y*, 30*m*, 30*c*, 30*k*) is irradiated by a laser scanner 10 with laser light 11 based on an image signal, so that an electrostatic latent image is formed. The electrostatic latent image is developed by each of developing rollers 42 (42*y*, 42*m*, 42*c*, 42*k*) associated with the photosensitive drums 30 (30*y*, 30*m*, 30*c*, 30*k*), respectively, so that a toner image (developer image) is formed on the surface of the photosensitive drum 30. Then, by applying a voltage to transfer rollers 18 (18*y*, 18*m*, 18*c*, 18*k*), the respective color toner images formed on the drums 30 are successively transferred onto a transfer belt 19. Thereafter, the toner image is formed on the transfer belt 19 are transferred by a transfer roller 3 onto a recording material P conveyed by a feeding roller 1 as a conveying (feeding) means. Then, the recording material P is conveyed to a fixing unit 6 constituted by a driving roller and a fixing roller containing a heater therein. In the fixing unit 8, heat and pressure are applied to the recording material P, so that the toner image transferred onto the recording material P are fixed. Thereafter, the recording material P on which the toner images are fixed is discharge don a discharge portion 9 by a discharging roller pair 7. As will be described later, a door 12 openably rotating about a shaft 27 is connected to holding members 14L and 14R for holding a cartridge tray 13 via a door link 29.

(General Structure of Process Cartridge)

Figure 3:
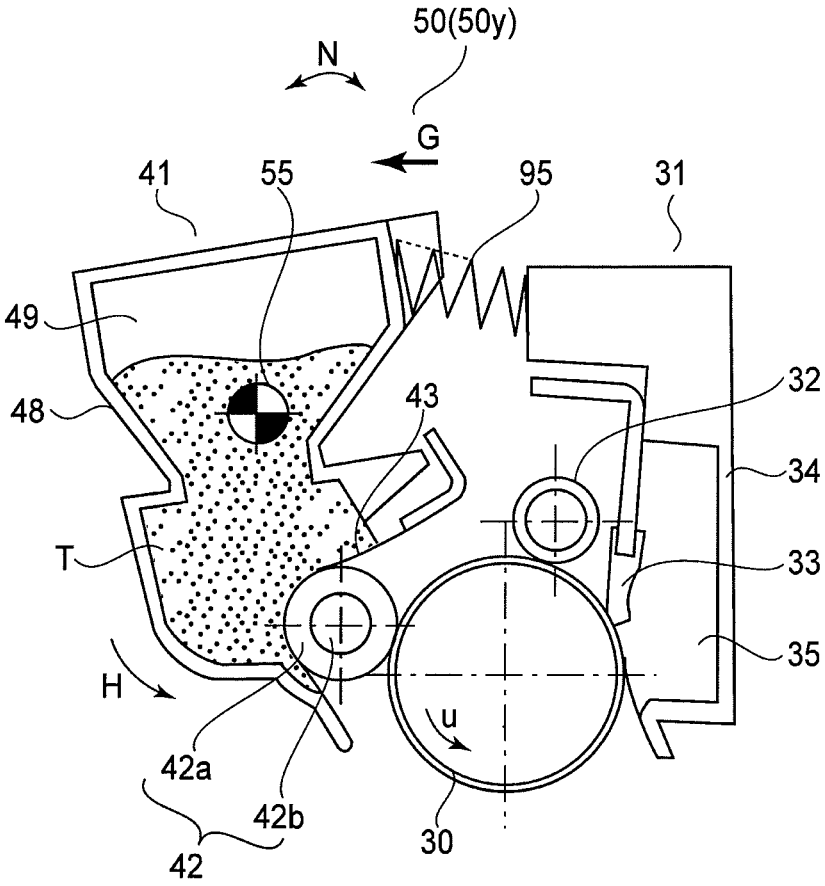
FIG. 3 is a general arrangement of the process cartridge during image formation.

FIG. 3 is a sectional side view of a single process cartridge, at a non-driving end side, detachably mountable to the apparatus main assembly. With respect to an axial direction of the drum 30 (hereinafter referred to as a longitudinal direction), one end side of the process cartridge to which a driving force is transmitted from the apparatus main assembly is referred to as a driving end side, and the other end side with respect to the longitudinal direction is referred to as the non-driving end side.

The cartridges 50*y*, 50*m*, 50*c* and 50*k* have the same structure except that they accommodate toners T different in color from each other. The cartridge 50 includes the drum 30 and process means acting on the drum 30. The process means may include a charging roller 32 for charging the drum 30, a developing roller 42 for developing the latent image formed on the drum 30, a cleaning blade 33 for removing residual toner remaining on the surface of the drum 33, and the like. Here, the cartridge 50 is divided into a photosensitive member unit (drum unit) 31 and a developing unit 41.

(Structure of Photosensitive Member Unit)

As shown in FIG. 3, the photosensitive member unit (drum unit) 31 is constituted by the drum 30, the charging roller 32, the cleaning blade 33, a drum frame 34, a residual toner accommodating portion 35, and cover members 36 and 37 ((A) and (B) of FIG. 4.). The drum 30 at the non-driving end side with respect to the longitudinal axis direction shown in (A) of FIG. 4 is rotatably supported by a supporting portion 37*b* of the cover member 37.

The drum 30 at the driving end side with respect to the longitudinal direction shown in (B) of FIG. 4 is rotatably supported by a supporting portion 36*b* of the cover member 36. Here, the cover members 36 and 37 are fixed on the drum frame 34 at longitudinal end sides of the drum frame 34. As will be described later, the cover members 36 and 37 are provided with positioning portions 36*c* and 37*c* and rotational direction positioning portions 36*d* and 37*d*.

Further, as shown in (B) of FIG. 4, at the longitudinal driving end side of the drum 30, coupling member 30*a* for transmitting the driving force to the drum 30 is provided. The coupling member 30*a* is, when the cartridge 50 is mounted in the apparatus main assembly 100, engaged with a main assembly-side coupling member 105 (105*y*, 105*m*, 105*c*, 105*k*) shown in FIG. 6. Then, to the coupling member 30*a*, the driving force from a driving source (motor) provided in the apparatus main assembly 100 is transmitted, so that the drum 30 is rotated in an arrow u direction as shown in FIG. 3 and (A) of FIG. 5.

In the drum unit 31, the charging roller 32 shown in FIG. 3 is supported by the drum frame 34 so that the roller 32 can be rotated by the drum 30 in contact to the drum 30. Further, the cleaning blade 33 is supported by the drum frame 34 so that the blade 33 can contact the peripheral surface of the drum 30 at predetermined pressure.

(Structure of Developing Unit)

The developing unit 41 includes, as shown in FIG. 3, the developing roller 42, a developing blade 43 for regulating a layer thickness of the toner on the surface of the developing roller 42, and a developing device frame 48. The developing device frame 48 includes a toner accommodating portion for accommodating the toner T to be supplied to the developing roller 42 and holds the developing blade 43. The toner regulated in a thin layer on the surface of a roller portion 42*a* of the developing roller 42 is conveyed to a developing position where the drum 30 and the developing roller 42 oppose each other.

At the developing portion, in the case of contact development, the drum 30 and the developing roller 42 contact each other. At the developing portion, the developer (toner) on the developing roller 42 is deposited on the electrostatic latent image, by a developing bias applied to the developing roller 42, formed on the surface of the drum 30. As a result, the electrostatic latent image is developed.

The developing unit 41 further includes a non-driving end side bearing unit 46 ((A) of FIG. 4) and includes a driving end side bearing unit 45 and a cover member 47 ((B) of FIG. 4).

Further, as shown in (B) of FIG. 4 and (B) of FIG. 5, the bearing unit 45 is fixed on the developing device frame 48 at the longitudinal driving end side and rotatably supports a core metal portion 42*b* (FIG. 3) of the developing roller 42 provided with a developing roller gear 69 at an end portion of the developing roller 42. The bearing unit 45 is provided with a coupling member 67 which is rotatably supported by the bearing unit 45 and the cover member 47. Further, the coupling member 67 is coaxially provided with a gear 67*a* and a coupling portion 67*b* which is a drive transmitting portion thereof and the gear 67*a* is engaged with the developing roller gear 69 to transmit the driving force from the main assembly to the developing roller 42.

Part (A) of FIG. 5 is a schematic diagram of the developing unit 41. The coupling portion 67*b* located at a rotation center (axis) of the developing unit 41 is rotated in an arrow Q direction, so that rotation moment H for bringing the developing roller 42 into contact to the drum 30 is generated. Thus, as shown (B) of FIG. 4, the cover member 47 is fixed outside the bearing unit 45 with respect to the longitudinal direction so as to cover the coupling member 67. Further, the cover member 47 is provided with a cylindrical portion 47*b* which protrudes from the surface thereof. Further, through an inside opening of the cylindrical portion 47*b*, the coupling portion 67*b* of the coupling member 67 is exposed. Here, the coupling member 67 is, when the cartridge 50 is mounted in the apparatus main assembly 100, engaged with a second main assembly-side coupling member 106 (106*y*, 106*m*, 106*c*, 106*k*). As a result, the driving force from the driving source (motor) provided in the apparatus main assembly 100 is transmitted.

(Assembling of Drum Unit and Developing Unit)

In the case where the developing unit 41 and the drum unit 31 are assembled, as shown in (B) of FIG. 4, an outer diameter portion of the cylindrical portion 47*b* is engaged with a supporting hole portion 36*a* at the driving end side. Further, at the non-driving end side, a projection 37*a* provided so as to be projected from the cover member 37 is engaged with a supporting hole portion 48*a* of the developing device frame 48. Thus, the developing unit 41 is swingably supported relative to the drum unit 31.

Figure 1:
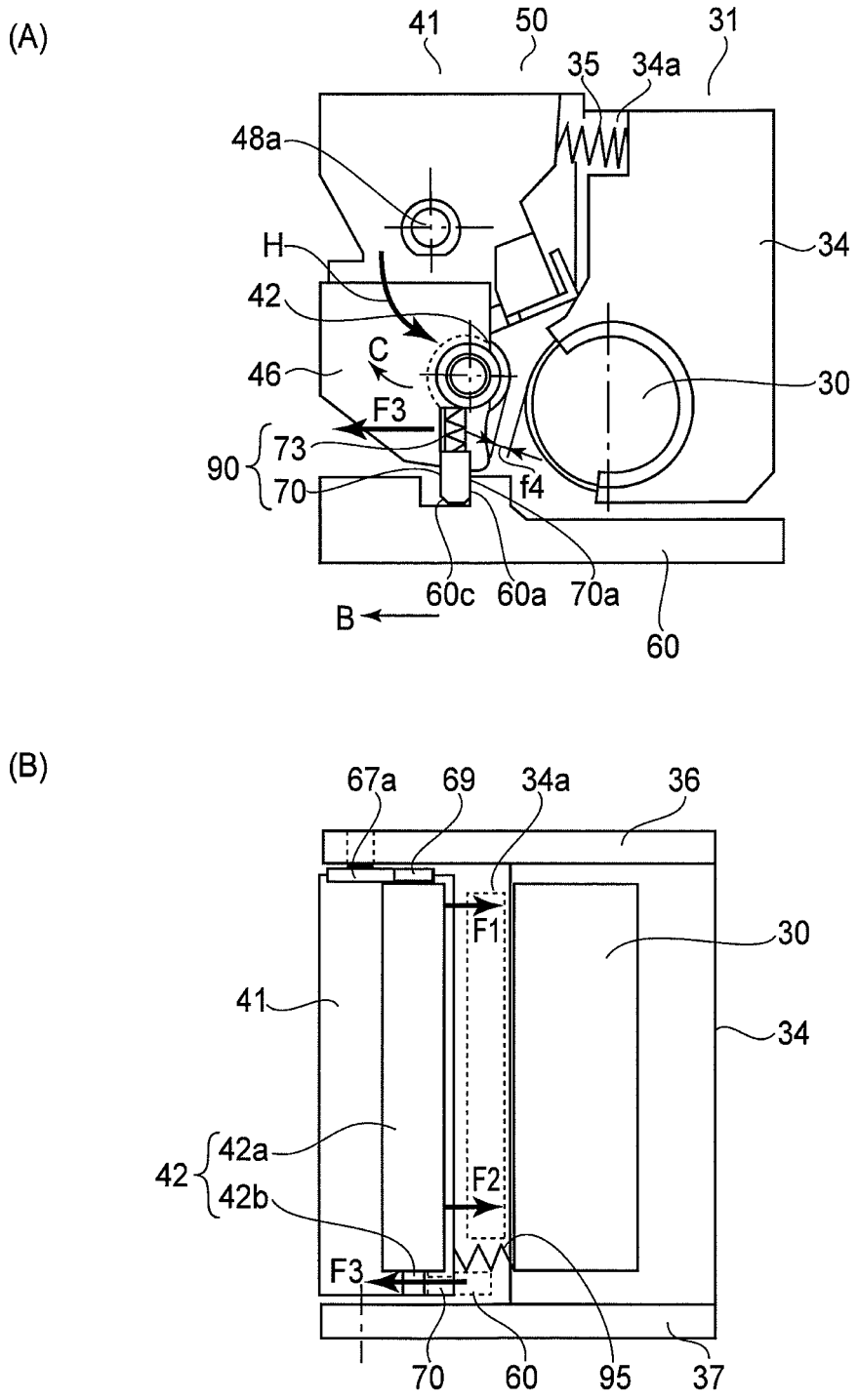

Further, at the non-driving end side, as shown in FIG. 3, the developing unit 41 is swingably about a rotation center 55 constituted by the supporting hole portion 48*a* ((A) of FIG. 1) and a cylindrical portion 47*b* ((B) of FIG. 4). Then, at the non-driving end side, the developing roller 42 is urged by an urging spring 95, which is an elastic member, so as to contact the drum 30. That is, by an urging force of the urging spring 95, the developing unit 41 is urged in an arrow G direction in FIG. 3, so that the rotation moment H acts on the developing unit 41 about the rotation center 55. For that reason, the developing roller 42 can be contacted to the drum 30 at predetermined pressure. A drum of the developing roller 42 at this time is referred to as a contact position. The urging spring 95 in this embodiment is, as shown in (B) of FIG. 1, disposed outside an exposure opening 34*a*, with respect to the longitudinal direction of the cartridge 50, through which the laser light for forming the electrostatic latent image on the drum 30 can pass. The reason why the urging spring 95 is disposed at the non-driving end side will be described later in detail.

(Force Receiving Portion)

A force receiving device for receiving a force from a force imparting (applying) member of the apparatus main assembly will be described below. As shown in (A) of FIG. 4 and FIG. 7, the cartridge 50 is provided with a force receiving device 90 for effecting contact and separation between the developing roller 42 and the drum 30 in the apparatus main assembly 100. The force receiving device 90 is constituted by a force receiving member 70 and a spring 73 as an urging means. The force receiving device 90 is provided at a lower portion of the cartridge 50 in a state in which the cartridge 50 is mounted in the apparatus main assembly 100. Further, the force receiving device 90 is disposed outside the transfer belt 19, described later, with respect to the longitudinal direction of the cartridge 50. This is because the force receiving device 90 is projected downward from the cartridge 50 and therefore is disposed to avoid the transfer belt 19. That is, in the case where the cartridge 50 alone is viewed, as shown in (B) of FIG. 1, the force receiving member 70 is disposed outside at least the roller portion 42*a* of the developing roller 42. Further, as shown in FIG. 7, the force receiving member 70 connected with the spring 73 is provided to the non-driving end side bearing unit 46 and is engaged with a guide portion 46*a* provided in the non-driving end side bearing unit 46. The force receiving member 70 is set so as not to be projected to a position at a level which is not lower than the lowest point of the cover member 37 even when it is located at a projected position. In FIG. 7, the projected lower end of the force receiving member 70 is located at a position which is higher than the lowest point of the cover member 37 by a distance f3. Further, the urging force of the spring 73 is set at a level at which the cartridge 50 can be pressed in by its own weight. A detailed operation of the force receiving device 90 will be described later.

(Pulling-Out Member for Cartridge)

Hereinbelow, an exchanging method of the cartridge will be described. FIG. 8 and (A) of FIG. 10 are a sectional view and a perspective view, respectively, showing a state, immediately before pulling-out of a cartridge tray 13, in which a door 12 of the apparatus main assembly 100 is opened. FIG. 9 and (B) of FIG. 10 are a sectional view and a perspective view, respectively, showing a state in which the cartridge tray 13 is pulled out and the cartridge 50 can be demounted from and mounted to the cartridge tray 13.

As shown in (A) and (B) of FIG. 10, at a front surface side of the apparatus main assembly 100, an opening 26 for permitting passage of the cartridge in order to insert the cartridge into the apparatus main assembly 100 and to demount the cartridge from the apparatus main assembly 100. Further, the door 12 as an openable member movable between a closed position in which the opening 26 is covered (closed) and an open position in which the opening 26 is opened (uncovered) is provided.

In this embodiment, the door 12 is rotatable about a (hinge) shaft 27 at its lower side relative to the apparatus main assembly 100. That is, the door 12 can be placed in a state in which the door 12 is opened from the apparatus main assembly 100 so that the opening 26 is largely opened and on the other hand, as shown in FIG. 2, the door 12 is closed to cover the opening 26. The door 12 is provided with a holding portion 12*a*.

A pair of opposing tray holding members 14L and 14R is provided, inside a main frame of the apparatus main assembly 100, in the neighborhood of longitudinal end portions of the apparatus main assembly 100. Between these tray holding members 14L and 14R, the cartridge tray 13 is horizontally held slidably in a front-rear direction (D1 and D2 directions in FIG. 9). That is, the cartridge tray 13 is movable linearly between the inside and outside of the apparatus main assembly 100. The cartridge tray 13 supports the cartridges 50 (50*y*, 50*m*, 50*c*, 50*k*) side by side. The cartridge tray 13 is provided with a holding portion 13*a*.

The portion 12 is connected via a door link 29 to the holding members 14L and 14R for holding the cartridge tray 13. Further, in interrelation with an opening operation of the door 12, the holding members 14L and 14R are pulled by the link 29 to be moved upward by a distance f2 shown in FIG. 8 along areas 120*c*, 120*b* and 120*a* of a guide groove 120 (FIG. 13) provided in the apparatus main assembly 100 and then is moved frontward. That is, the holding members 14L and 14R are changed from the state of FIG. 2 during image formation in which these members are positioned at the positioning portion to the state of FIG. 8, so that the holding members 14L and 14R are moved from the state during image formation to an upper rightward position. As a result, as shown in FIG. 8 and (A) of FIG. 10, the holding members 14L and 14R are pulled out to a position in which these members are outward projected through the opening 26 to the outside of the apparatus main assembly 100 by a predetermined distance.

Interrelation with the movement of the holding members 14L and 14R, a photosensitive member drum driving coupling 105 at the apparatus main assembly side and a developing device driving coupling 106 are retracted in the longitudinal direction, so that the connection between the drive transmitting portions by the couplings is released. Further, the urging of the cartridges 50 by the urging mechanism (described later with reference to FIG. 12) which fixes the respective cartridges 50 is released.

Further, positioning fixing of the cartridge tray 13 which moves between the inside and outside of the apparatus main assembly 100 while supporting the respective cartridges 50 is released, so that the cartridge tray 13 is moved to an upper rightward position together with the holding members 14L and 14R (arrow J direction in FIG. 8).

Each cartridge 50 is, as described above, raised from the positioning portion shown in FIG. 8 by the distance indicated by f2, so that a lower surface of the drum 30 of each cartridge 50 is separated from the surface of the transfer belt 19 to be placed in a non-contact state (hereinafter referred to as a mounting position). At this mounting position, the cartridge tray 13 can be pulled out from the apparatus main assembly 100. That is, the user holds the holding portion 13*a* of the cartridge tray 13 exposed through the opening 26 and horizontally slides and moves the cartridge tray 13, in the D2 direction shown in FIG. 9, relative to the holding members 14L and 14R. Thus, as shown in FIG. 9 and (B) of FIG. 10, the cartridge tray 13 is pulled out to a predetermined pulled-out position outside the apparatus main assembly 100 through the opening 26 (hereinafter referred to as a pulling-out position).

As a result, the entire four (first to fourth) cartridges 50 (50*y*, 50*m*, 50*c*, 50*k*) held by the cartridge tray 13 are passed through the opening 26 and are exposed to the outside of the apparatus main assembly 100. Thus, the upper surfaces of all the cartridges 50 are opened (exposed). When the cartridge tray 13 is pulled out to the pulled-out position, by a stopper, further pulling-out movement of the cartridge tray 13 is prevented. The cartridge tray 13 is stably held in a state, in which the cartridge tray 13 is horizontally pulled out to the pulled-out position, by the holding members 14L and 14R. As described above, the cartridge tray 13 is movable to an image formation position in which the electrostatic latent image can be formed on the drum 30, the mounting position in which the cartridge 50 is mounted inside the apparatus main assembly 100, and the pulling-out position in which the cartridge 50 is detachably mountable at the outside of the apparatus main assembly 100.

The cartridge tray 13 is, as shown in FIGS. 8 and 9, supports the cartridges 50 with rough accuracy in a period from the mounting of each cartridge 50 in the apparatus main assembly to the positioning of each cartridge 50 at the image formation position. Further, each cartridge 50 can be vertically extracted (demounted) from and inserted (mounted) in the cartridge tray 13. The user raises and extracts upward the cartridge 50, which is used up and is to be exchanged, from the cartridge tray 13 as representatively shown in FIG. 9 as the cartridge 50*k*. Then, a fresh cartridge 50 is engaged into the cartridge tray 13 from above.

(Mounting of Cartridge in Apparatus Main Assembly and Positioning of Cartridge Relative to Apparatus Main Assembly)

The user horizontally slides and moves, after the exchange of the cartridge 50 with respect to the cartridge tray 13 is made, the pulled-out cartridge 13 in the D1 direction shown in FIG. 9 in a manner reverse to the above-described manner. Then, the user sufficiently pushes the cartridge tray 13 into the apparatus main assembly 100 until further pushing-in movement of the cartridge tray 13 is prevented by the stopper. Thus, the cartridge tray 13 is returned to the mounting position shown in FIG. 8.

Then, in interrelation with a closing operation for rotating and closing the portion 12, the holding members 14L and 14R is pushed by the link 29 to be moved in the apparatus main assembly 100 along the areas 120*a*, 120*b* and 120*c* of the guide groove 120 (FIG. 13). That is, the holding members 14L and 14R are moved from the position in which these members are moved upward and rearward by the predetermined distance to the position downward in the rear direction by the predetermined distance. In other words, in FIG. 8, the holding members 14L and 14R are moved to a lower left position.

With respect to this movement, as shown in (A) and (B) of FIG. 11, positioning members 102 (driving end side) and positioning members 101 (NDES) are provided, with respect to the longitudinal direction of the apparatus main assembly 100, at positions corresponding to the cover members 36 and 37 of the cartridge 50. In interrelation with the closing operation of the door 12, when the cartridge 50 is moved downward in the rear direction, the positioning portions (to be supported) 36*c* and 37*c* shown in (A) and (B) of FIG. 12 are engaged with the recessed portions of the positioning members 101 and 102. As a result, the position of the cartridge 50 relative to the apparatus main assembly 100 is held.

Part (A) of FIG. 12 shows a positioned and fixed state of the cartridge at the driving end side relative to the apparatus main assembly, and (B) of FIG. 12 shows a positioned and fixed state of the cartridge at the non-driving end side relative to the apparatus main assembly. When each cartridge is mounted in the apparatus main assembly, the portions to be supported 36*c* and 37*c* at the driving end side and the non-driving end side, respectively, are engaged with the main assembly-side positioning portions 102 and 101 at the driving end side and the non-driving end side, respectively, so that the apparatus main assembly supports the cartridges from below. That is, each cartridge is supported in the apparatus main assembly at least at two positions with respect to the longitudinal direction of the drum 30. In this embodiment, the main assembly-side positioning portions 101 and 102 at the non-driving end side and the driving end side, respectively, are V-shaped grooves formed and provided along longitudinal portions of a pair of left and right 101L and 101R, respectively, which are oppositely fixed in the apparatus main assembly and extend in the front-rear direction as the longitudinal direction. Into these V-shaped grooves, downward arcuate portions of the portions to be supported are engaged, so that the positioning of each cartridge relative to the apparatus main assembly is effected. That is, the cartridge-side portions to be supported 37*c* and 36*c* have a cylindrical shape having a drum axis as a center axis and are constituted so that two arcuate surfaces as a part of the cylindrical shape are engaged with two inclined surfaces having the V-shape provided at the main assembly-side positioning portions 101 and 102, respectively.

Further, when each cartridge 50 is mounted in the apparatus main assembly, portions to be urged at its upper surfaces at the non-driving end side and the driving end side are urged downward by main assembly side urging members 146L and 146R at the non-driving end side and driving end side of the apparatus main assembly. As a result, the portions to be urged 37*c* and 36*c* at the non-driving end side and the driving end side are urged by the main assembly-side positioning portions 101 and 102 at the non-driving end side and the driving end side, respectively, so that the cartridges are positioned and fixed.

The main assembly-side urging members 146L at the non-driving end side associated with the respective cartridges are disposed along longitudinal lower surfaces of an urging portion holding member 147L at the non-driving end side. Each of the main assembly-side urging members 146L is slidably held by the urging portion holding member 14 so as to be vertically movable via an associated elastic member (compression coil spring) 148L for generating an urging force.

Further, the main assembly-side urging members 146R at the driving end side associated with the respective cartridges are also disposed along longitudinal lower surfaces of an urging portion holding member 147R at the driving end side. Each of the main assembly-side urging members 146R is slidably held by the urging portion holding member 14 so as to be vertically movable via an associated elastic member 148R for generating an urging force.

The urging portion holding members 147L and 147R are vertically translated in the apparatus main assembly in interrelation with an opening and closing operation of the door 12 (an operation of the door link 29). When the door 12 is closed relative to the apparatus main assembly, the urging portion holding members 147L and 147R are pressed down via the door link 29, so that the lower surfaces of the main assembly-side urging members 146L and 146R contact the portions to be urged at the upper surfaces of the cartridges. Then, by subsequent pressing-down movement of the urging portion holding members 147L and 147R, the elastic members 148L and 148R are compressed between the urging portion holding members 147L and 147R and the main assembly-side urging members 146L and 146R. By reaction force of the compression of the elastic members 148L and 148R, the portions to be urged of the cartridges are urged with the main assembly-side urging members 146L and 146R. As a result, the portions to be supported 132L and 132R at the non-driving end side and the driving end side are urged by the main assembly-side positioning portions 144L and 144R at the non-driving end side and the driving end side, respectively, the cartridges are positioned and fixed.

When the cartridge tray 13 is positioned relative to the apparatus main assembly, the rotational direction positioning preventing portions 36*d* and 37*d* of the cartridges are positioned relative to the apparatus main assembly. As a result, the movement of each cartridge 50 in the rotational direction (arrow N direction of FIG. 3) is prevented. Thus, the position of each cartridge 50 is determined relative to the apparatus main assembly. That is, the lower surface of the drum 30 of each cartridge 50 in a contact state to the surface of the transfer belt 19. As a result, each cartridge 50 (50*y*, 50*m*, 50*c*, 50*k*) is restored to the state of FIG. 2 in which the cartridge is mounted at the image formation position in the apparatus main assembly 100. Further, the photosensitive drum driving coupling 105 and the developing device driving coupling 106 at the apparatus main assembly-side associated with drive inputting portions of the respective cartridges 50 (50*y*, 50*m*, 50*c*, 50*k*) are projected, so that the drive transmitting portions are connected.

(Separating Mechanism of Apparatus Main Assembly)

A mechanism for operating a force receiving device 90 provided to the cartridge 50 will be described. FIG. 14 is a schematic view showing a structure of the force imparting member 60 inside the apparatus main assembly. FIG. 15 is a schematic view showing the cartridge during image formation. Part (A) of FIG. 16 is a schematic view showing a state in which the developing unit 41 of the cartridge is contacted to the drum 30 during image formation. Further, (A) of FIG. 1 is a schematic view showing a state in which the developing unit 41 of the cartridges separated from the drum 31 when the image is not formed.

As shown in FIG. 14, at the non-driving end side of the apparatus main assembly 100, the force imparting member 60 of the apparatus main assembly is provided. Further, as shown in FIG. 15, in order to operate the force imparting member 60, gears 112 and 113 for transmitting the driving force from the motor as the driving source provided in the apparatus main assembly are provided. The gear 112 is provided with a cam portion 112*a*. The cam portion 112*a* is engaged with cam engagement surfaces 60*d* and 60*e* (FIG. 14) provided in the force imparting member 60.

During the image formation, when the gear 112 is rotated in a predetermined amount by the driving force from the above-described motor, the cam portion 112*a* and the cam engagement surface 60*d* provided in the force imparting member 60 are engaged, so that the force imparting member 60 is moved in an arrow E direction shown in FIG. 15 and (A) of FIG. 16. As a result, the developing roller 42 is in a contact state to the drum 30. During the image formation, the force receiving portion 70 of the cartridge 50 and the force imparting member 60 of the apparatus main assembly are in a non-contact state, so that the developing unit 41 can effect development without being influenced by the force imparting member 60. Further, when the gears 112 and 113 are rotated in the predetermined amount by the motor, the cam portion 112*a* is engaged with the cam engagement surface 60*e* (FIG. 14) of the force imparting member 60 and the force imparting member 60 is moved in the arrow B direction, so that the separation of the developing roller 42 from the drum 30 is performed. When the image formation is not effected, the cartridge 50 is held in the separated state. In the case where the force imparting member 60 shown in (A) of FIG. 16 is moved in the arrow E direction, the developing roller 42 provided in the bearing unit 46 at the non-driving end side and the drum 30 provided in the drum frame 34 are in the contact state. On the other hand, in the case where the force imparting member 60 shown in (A) of FIG. 1 is moved in the arrow B direction, the force receiving member 70 receives the force from a side surface 60*a* of the engaging groove of the force imparting member 60. As a result, the developing unit 41 is rotated (moved) in the arrow C direction shown in (A) of FIG. 1 with the center of a hole 48*a* of the developing device frame 48 as the rotation axis, so that the developing roller 42 and the drum 30 are in the separated state with a separation gap f4 ((A) of FIG. 1). The position of the developing unit 41 at this time is referred to as a separated position.

When the image formation is completed, the force imparting member 60 moves in the arrow B direction shown in (A) of FIG. 1. Then, a right side surface 70*a* of the force receiving portion 70 provided in the non-driving end side bearing unit 46 of the cartridge 50 and the surface 60*a* of the force imparting member 60 of the apparatus main assembly are engaged, so that the developing unit 41 is moved to the separated position against the urging force of the spring 95. When the image formation is not effected, the cartridge 50 is kept in the separated state. Further, the cartridge 50 is, after being mounted in the apparatus main assembly, placed in the separated state. Further, also after the completion of the image formation, the operation of the apparatus main assembly is ended in the separated state. This state is referred to as a home position.

(Mounting of Process Cartridge in Apparatus Main Assembly and Operation of Force Receiving Device)

Next, a series of operations from the mounting of the cartridge 50 in the apparatus main assembly until the drum 30 and the developing roller are separated and the cartridge 50 is located at the home position will be described. As shown in FIG. 9, the cartridges 50*y*, 50*m*, 50*c* and 50*k* are mounted in the arrow direction from above the cartridge tray 13 which is pulled out to the pulling-out position. Then, by moving the cartridge tray 13 in the arrow D1 direction, the cartridges 50*y*, 50*m*, 50*c* and 50*k* are passed through the opening 26 to enter the apparatus main assembly 100. At a stage in which the cartridges 50*y*, 50*m*, 50*c* and 50*k* enter the apparatus main assembly 100, as shown in (A) of FIG. 16, the force receiving member 70 is mounted in a projected state.

Thereafter, as shown in FIG. 2, by moving the door 12 to the closed position, the tray holding members 14L and 14R are moved in a direction in which the members approach the transfer belt 19 (toward the lower and rear side). As a result, the cartridges 50*y*, 50*m*, 50*c* and 50*k* are also moved, so that the surfaces of the drums 30 are contacted to the surface of the transfer belt 19. That is, as described above, each cartridge 50 is positioned by the positioning portions 101 and 102 of the apparatus main assembly and is also urged by the urging portion, thus being in the image formation state.

Here, (B) of FIG. 16 shows a state before the image is formed in the state in which the cartridge is mounted in the apparatus main assembly. The force receiving portion 70 provided in the non-driving end side bearing unit 46 of the cartridge 50 interferes with a sliding surface 60*b* of the force imparting member 60 of the apparatus main assembly, so that the spring 73 provided in the force receiving mechanism 90 is compressed to regulate the position of the spring 73. The position of the spring 73 at this time is referred to as a regulation position. A load on the spring 73 of the force receiving mechanism 90 is, as described above, set at a value sufficiently smaller than a load corresponding to the self weight of the cartridge 50, so that the load on the spring 73 does not impair the positioning of the cartridge 50 relative to the apparatus main assembly even when the force receiving member 70 is located at the regulation position.

(Determination of Home Position)

When the power of the image forming apparatus 100 is turned on and detection of the door 12 moves to or located at the closed position is made, the driving source (motor) of the apparatus main assembly 100 starts its drive and the force imparting member 60 shown in (B) of FIG. 16 starts its movement in the arrow E direction ((A) of FIG. 16). At this time, the force receiving portion 70 of the cartridge 50 is located at the regulation position but with the movement of the force imparting member 60, is kept at the regulation position while being slid on the sliding portion 60*b* of the force imparting member 60.

Then, when the force imparting member 60 reaches the position shown in (A) of FIG. 16, the force receiving portion 70 located at the regulation position enters a groove 60*c* of the force imparting member 60 by a repelling force of the spring 73, so that the cartridge 50 is in the same state as that of the cartridge 50 alone. Further, the force imparting member 60 moves in the arrow B direction shown in (A) of FIG. 1, the surface 60*a* of the force imparting member 60 and the surface 70*a* of the force receiving portion 70 are engaged. As a result, the developing unit 41 is rotated about the rotation center thereof formed at the center of the hole 48*a* of the developing device frame 48, so that the developing roller 42 and the drum 30 are separated. By the above-described operations, the cartridge 50 is positioned relative to the apparatus main assembly to be located at the home position in which the separation is held, thus being placed in a stand-by state.

Next, when the image is formed, in order to perform the contact between the developing roller 42 of the developing unit 41 and the drum 30, the force imparting member 60 is moved in the arrow E direction. As a result, as shown in (A) of FIG. 16, the force receiving portion 70 is in a state in which it does not receive the force from the force imparting member 60. Therefore, by the urging force of the spring 95 provided between the developing unit 41 and the photosensitive member unit 31, the developing roller 42 and the drum 30 are urged in the contact direction, so that each cartridge 50 (50*y*, 50*m*, 50*c*, 50*k*) is in an image formable state.

Here, the drum 30 is rotated at the non-driving end side by receiving the driving force from the apparatus main assembly by the coupling 30*a* (associated with the main assembly-side coupling 105 shown in FIG. 6 and (A) of FIG. 11). Further, the developing unit 41 is rotated at the driving end side by receiving the driving force from the apparatus main assembly by the coupling 67*b* (associated with the main assembly-side coupling 106 shown in FIG. 6 and (A) of FIG. 11) located at the rotation center position.

The main assembly-side coupling 105 which is a driving rotatable member for transmitting a first driving force from the apparatus main assembly is engaged with the coupling 67*a* which is a drive transmitting portion for transmitting the first driving force at one end side of the developing unit 41 with respect to the longitudinal direction. Then, when the first driving force is transmitted, a contact force for moving the developing unit 41 in the direction in which the developing roller 42 approaches the drum 30 is generated. That is, the coupling 67*b* provided at the rotation center 55 is driven and rotated in a direction (counterclockwise direction in FIG. 3) in which the contact force based on the rotation moment H is generated. Thus, at the driving end side, the developing roller 42 revolves around the rotation center in the direction in which the contact force based on the rotation moment H is generated. Then, with the revolution, the developing roller 42 rotates in a direction opposite from an arrow Q direction by rotation of the developing roller gear 69 (engaged with the gear 67*a* provided coaxially with the coupling 67B) shown in (B) of FIG. 5. The rotation direction of the developing roller 42 is such that an end portion of the developing blade 43 counter-directionally acts on the developing roller 42.

In this embodiment, as shown in (B) of FIG. 1, at the driving end side of the cartridge 50 during the image formation, the rotation moment H ((A) of FIG. 1) generated at the drive inputting portion is used as a contact force F1 between the developing roller 46 and the drum 30. At the non-driving end side, the developing device frame 48 constituting the developing unit 41 is a resinous mold product and therefore the contact force F1 by the rotation moment H generated at the driving end side cannot be obtained as it is. At the non-driving end side, in order to absorb deviation of the axes of the developing roller 42 and the drum 30 caused due to integration of dimensional tolerances of respective parts, the spring 95 is provided to generate a contact force F2. During the image formation, the contact force F2 by the spring 95 may preferably be equal to the contact force F1 by the rotation moment H. As a result, a balance between the forces exerted inside the process cartridge can be stabilized when the image is formed.

Further, during non-image formation, the contact force F1 is eliminated at the driving end side and at the non-driving end side, a force F3 is exerted against the urging force of the spring 95 for moving and urging the developing roller 42 toward the contact position to the drum 30. That is, the force F3 acts on the force receiving portion 90 for being moved between the contact position and the separated position by the force imparting member 60 moved by the second driving force. As a result, the image bearing member and the developing roller are separated, so that it is possible to not only prevent deformation of the developing roller but also stabilize the balance of the forces acting on the inside of the process cartridge during development and separation in both of the case where the image is formed and the case where the image is not formed.

Thus, in this embodiment, at the longitudinal of the developing unit, the driving force is transmitted from the apparatus main assembly of the image forming apparatus to the developing unit in the case of forming the image to generate the contact force F1 based on the rotational movement for moving the developing roller toward the image bearing member. Further, in the case where the image is not formed at the longitudinal driving end side of the developing unit, the driving force is not transmitted, so that the contact force F1 is not generated. Generally, after the separating operation is performed, the rotations of the developing roller 42 and the drum 30 are stopped and therefore the contact force based on the rotation movement disappears in view of the operation for stopping the rotations in the case where the image is not formed. On the other hand, at the longitudinal non-driving end side of the developing unit, the urging member 95 for generating the contact force based on the urging force for urging the developing roller 42 toward the drum 30 in the case where the image is formed is provided. Further, at the longitudinal non-driving end side of the developing unit portion for receiving the force, from the apparatus main assembly of the image forming apparatus, for displacing the developing roller 42 to the position separated from the drum 30 against the urging force of the urging member in the case where the image is not formed is provided.

Here, rotation start timing of the developing roller 42 and the drum 30 in this embodiment will be described. Before the developing roller 42 and the drum 30 are contacted, the drum 30 rotates and the developing roller 42 is also rotated by receiving the driving force from the apparatus main assembly 100 by the coupling portion 67*a*. For this reason, compared with the case where the developing roller 42 and the drum 30 are contacted in a state in which either one of them is stopped, a difference in peripheral surface speed between the drum 30 and the developing roller 42 can be reduced. As a result, a degree of abrasion of the drum 30 and the developing roller 42 can be reduced.

Then, when the image formation is ended, as described above, the drum 30 and the developing roller 42 are separated by moving the force imparting member 0 in the arrow B direction. After the separation, the rotations of the developing roller 42 and the drum 30 are stopped. For this reason, similarly, the difference in peripheral surface speed between the drum 30 and the developing roller 42 can be reduced, so that the degree of abrasion of the drum 30 and the developing roller 42 can be reduced. As a result, an image quality can be further improved.

Next, an operation of the apparatus main assembly after the image formation will be described. In order to separate the developing roller 42 and the drum 30, the force imparting member 60 of the apparatus main assembly is moved in the arrow B direction in (A) of FIG. 1. As a result, the force receiving portion 70 of the cartridge 50 is also moved, so that the developing unit 41 is swung about the rotation center and thus the developing roller 42 and the drum 30 are separated. After the separating operation is performed, the rotations of the developing roller 42 and the drum 30 are stopped. Further, the driving portions of the transfer belt 19, the fixing unit 6 and the like of the apparatus main assembly are also stopped, so that the operation of the image forming apparatus is completed.

In this state, the developing unit 41 is in the following state. That is, as described above, at the driving end side, the driving force from the apparatus main assembly 100 is stopped and therefore there is no generation of the moment H acting on the developing unit 41, so that the developing unit 41 is in a state in which no load is exerted thereon (i.e., a state in which the contact force based on the rotation moment for moving the developing roller toward the image bearing member disappears). On the other hand, at the non-driving end side, the urging force by the spring 95 is exerted but the developing roller 42 and the drum 30 are in the separated state and thus an amount of compression is increased, so that the urging force is higher than that in the contact state shown in (B) of FIG. 16. For this reason, at the non-driving end side, the force for bringing the developing roller 42 into contact to the drum 30 is exerted by the spring 95 is larger than that during the image formation. Therefore, in the case where the developing unit 41 is considered as a whole, the developing unit 41 is in a state in which there is no load and thus the developing unit 41 is stable at the non-driving end side but is in a state, at the driving end side, in which a strong force is exerted in a direction in which the developing roller 42 is contacted to the drum 30. As a result, a torsional force with respect to the longitudinal direction acts on the developing unit 41.

On the other hand, in this embodiment, as shown in (B) of FIG. 1, the separating mechanism 90 and the force imparting member 60 of the apparatus main assembly are disposed at the non-driving end side and in the separated state, the force imparting member 60 of the apparatus main assembly and the force receiving portion 70 of the cartridge 50 are engaged. That is, the spring 95 and the separating mechanism 90 are provided at the same side (non-driving end side) with respect to the longitudinal direction, so that the torsional force with respect to the longitudinal direction can be suppressed. That is, the influence of the urging force of the spring 95 at the non-driving end side can be eliminated by supporting the spring 95 by the engaging portions (70*a* and 60*a* in FIG. 1) of the separating mechanism 90 provided at the non-driving end side, so that the torsional force with respect to the longitudinal direction can be absorbed. That is, in this embodiment, at the non-driving end side, in the case where the image is not formed, the developing roller is displaced toward the separated position from the image bearing member. As a result, the developing unit 41 suppresses the torsional force even when the spring 95 is used, so that the separated state of the developing unit can be maintained with stable balance even in the case where the apparatus main assembly 100 is kept in the separated state for a long time. Further, in this embodiment, the urging member is provided only at the non-driving end side (and is not provided at the driving end side), so that it is possible to realize a simple constitution with less number of parts.

Other Embodiments

The separating mechanism at the non-driving end side is not limited to the illustrated mechanism but may also be arbitrary one. For example, with respect to the spring 95 at the non-driving end side, a tension spring may also be used in place of the urging spring.

In the above embodiment, the coupling for obtaining the driving rotational force from the apparatus main assembly of the image forming apparatus is provided at the rotational center position of the developing unit and is driven and rotated in the direction in which the contact force based on the rotational moment for moving the developing roller toward the image bearing member is generated is described. However, the present invention is not limited thereto but may also employ a constitution in which the coupling for obtaining the driving rotational force from the apparatus main assembly of the image forming apparatus is disposed at a position different from the rotation center position.

Further, the main assembly-side force imparting member 60 is provided at the non-driving end side but may also be provided at the driving end side, so that the force imparting action may also be effected at the non-driving end side via the intermediate drive transmitting system.

Incidentally, in the case of non-contact development, the developing roller is separated slightly from the drum (and is regarded as being in contact to the drum) when the image is formed, but when the image is not formed, similarly as in the case of contact development, the developing roller is separated from the drum by the force acting on the force receiving portion.

As described above, according to the present invention, by disposing the urging member and the force receiving portion at the non-driving end side, in the case where the image is not formed, the development and separation state is maintained with stable balance and also when the image is formed again, it becomes possible to obtain a stable image quality.

According to the present invention, the electrophotographic photosensitive drum and the developing roller are separated, so that the deformation of the developing roller can be prevented and when the development and separation are effected, it is possible to suppress the torsional force with respect to the longitudinal direction of the developing unit. That is, when the development and separation are effected, the balance of the forces acting on the inside of the process cartridge can be stabilized.

While the invention has been described with reference to the structures disclosed herein, it is not confined to the details set forth and this application is intended to cover such modifications or changes as may come within the purpose of the improvements or the scope of the following claims.

This application claims priority from Japanese Patent Applications Nos. 141622/2010 filed Jun. 22, 2010 and 122385/2011 filed May 31, 2011, which are hereby incorporated by reference.

What is claimed is:

1. A process cartridge detachably mountable to a main assembly of an image forming apparatus, said process cartridge comprising:

a photosensitive member unit including an electrophotographic photosensitive member;

a developing unit including a developing roller for developing an electrostatic latent image formed on said electrophotographic photosensitive member, said developing unit being movable between a contact position in which said developing roller is contacted to said electrophotographic photosensitive member and a separated position in which said developing roller is separated from said electrophotographic photosensitive member;

a drive transmitting portion for transmitting a driving force for driving said developing roller at one longitudinal end side of said developing unit, wherein said drive transmitting portion provides, to said developing unit, a force for moving said developing unit in a direction from the separated position toward the contact position by receiving the driving force;

an urging member for urging, at the other longitudinal end side of said developing unit, said developing unit so that said developing unit is moved in the direction from the separated position toward the contact position; and a force receiving portion, provided only at the other longitudinal end side of said developing unit, for receiving a force, from the main assembly, for moving said developing unit from the contact position to the separated position.

2. The cartridge according to claim 1, wherein, in a state in which said process cartridge is mounted in the main assembly, said urging member is disposed at an upper portion of said process cartridge and said force receiving portion is disposed at a lower portion of said process cartridge.

3. The cartridge according to claim 2, wherein said force receiving portion is disposed outside a roller portion of said developing roller with respect to a longitudinal direction of said developing unit.

4. The cartridge according to claim 2, wherein said urging member is disposed outside an exposure opening, through which light for forming the electrostatic latent image on said electrophotographic photosensitive member, with respect to a longitudinal direction of said developing unit.

5. The cartridge according to claim 1, wherein said developing unit is provided rotatably about a rotation center relative to said photosensitive member unit.

6. An image forming apparatus for forming an image on a recording material, said apparatus comprising:

(i) a process cartridge detachably mountable to a main assembly of said apparatus, comprising:

a photosensitive member unit including an electrophotographic photosensitive member;

a developing unit including a developing roller for developing an electrostatic latent image formed on said electrophotographic photosensitive member, said developing unit being movable between a contact position in which said developing roller is contacted to said electrophotographic photosensitive member and a separated position in which said developing roller is separated from said electrophotographic photosensitive member;

a drive transmitting portion for transmitting a driving force for driving said developing roller at one longitudinal end side of said developing unit, wherein said drive transmitting portion provides, to said developing unit, a force for moving said developing unit in a direction from the separated position toward the contact position by receiving the driving force;

an urging member for urging, at the other longitudinal end side of said developing unit, said developing unit so that said developing unit is moved in the direction from the separated position toward the contact position; and a force receiving portion, provided only at the other longitudinal end side of said developing unit, for receiving a force, from the main assembly, for moving said developing unit from the contact position to the separated position; and (ii) conveying means for conveying the recording material.

7. The apparatus according to claim 6, wherein, in a state in which said process cartridge is mounted in the main assembly, said urging member is disposed at an upper portion of said process cartridge and said force receiving portion is disposed at a lower portion of said process cartridge.

8. The apparatus according to claim 7, wherein said force receiving portion is disposed outside a roller portion of said developing roller with respect to a longitudinal direction of said developing unit.

9. The apparatus according to claim 7, wherein said urging member is disposed outside an exposure opening, through which light for forming the electrostatic latent image on said electrophotographic photosensitive member, with respect to a longitudinal direction of said developing unit.

10. The apparatus according to claim 6, wherein said developing unit is provided rotatably about a rotation center relative to said photosensitive member unit.

* * * * *